US007701336B1

(12) United States Patent
Willms et al.

(10) Patent No.: US 7,701,336 B1
(45) **Date of Patent: *Apr. 20, 2010**

(54) DETECTION OF NUCLEAR MATERIALS HIDDEN INSIDE CARGO SHIPMENTS BY USING SENSOR FUSION TECHNIQUE

(75) Inventors: Paul Henry Willms, Everett, WA (US); Les E. Atlas, Seattle, WA (US)

(73) Assignee: Erudite, Inc., Tacoma, WA (US)

( * ) Notice: Subject to any disclaimer, the term of this patent is extended or adjusted under 35 U.S.C. 154(b) by 394 days.

This patent is subject to a terminal disclaimer.

(21) Appl. No.: 11/641,567

(22) Filed: Dec. 18, 2006

Related U.S. Application Data

(63) Continuation-in-part of application No. 10/931,730, filed on Aug. 31, 2004, now Pat. No. 7,151,447.

(51) Int. Cl.
*G08B 21/00* (2006.01)

(52) U.S. Cl. ..... 340/540; 250/390.04; 376/159; 376/57

(58) Field of Classification Search ..... 340/540, 340/539.26; 250/390.04; 376/159; 378/57
See application file for complete search history.

(56) References Cited

U.S. PATENT DOCUMENTS 5,051,723 A 9/1991 Long et al.
5,076,993 A * 12/1991 Sawa et al. ..... 376/159
5,838,759 A * 11/1998 Armistead ..... 378/57
6,959,248 B2 * 10/2005 Gard et al. ..... 702/22
2003/0136902 A1 * 7/2003 Nakashige et al. ..... 250/282
2004/0174259 A1 * 9/2004 Peel et al. ..... 340/539.26

* cited by examiner

*Primary Examiner*—Thomas J Mullen
(74) *Attorney, Agent, or Firm*—Boris G. Tankhilevich

(57) ABSTRACT

A method for identifying at least one nuclear threat to homeland security, wherein such each nuclear threat is either hidden inside at least one cargo container before transit, or is placed inside at least one cargo container while in transit. Each such nuclear threat while interacting with its surroundings generates a unique nuclear threat signature. The method comprises: (A) detecting at least one nuclear threat signature; (B) measuring a background nuclear threat signature distribution in a nuclear threat-free environment; (C) comparing each detected nuclear threat signature with the background nuclear threat signature distribution; (D) if deviation of the detected nuclear threat signature from the background nuclear threat signature distribution is statistically significant, selecting the detected nuclear threat signature to be a part of an array of statistically significant detected nuclear threat signatures; and (E) substantially continuously processing the array of selected statistically significant detected nuclear threat signatures in order to determine a likelihood of each such nuclear threat.

20 Claims, 6 Drawing Sheets

DETECTION OF NUCLEAR MATERIALS HIDDEN INSIDE CARGO SHIPMENTS BY USING SENSOR FUSION TECHNIQUE

This is a continuation-in-part of the U.S. patent application Ser. No. 10/931,730 filed on Aug. 31, 2004, now U.S. Pat. No. 7,151,447 and entitled "DETECTION AND IDENTIFICATION OF THREATS HIDDEN INSIDE CARGO SHIPMENTS"

BACKGROUND OF THE INVENTION

1. Field of the Invention

The present invention relates to the field of threat detection and identification, and more specifically, to the field of detection and identification of nuclear threats hidden inside cargo shipments.

2. Discussion of the Prior Art

Guarding against illicit cargo trying to enter the country by land, sea or air shipping containers is a difficult problem. Each year more than 48 million loaded cargo containers move between the world's seaports. Six million loaded cargo containers arrive in the U.S. each year, but only 5 percent have their content visually inspected or x-rayed, opening the possibility that the terrorists could use them to smuggle in nuclear material, explosives, or even themselves.

Combinations of multiple modes of sensing (sensor fusion) is well-known to offer performance advantages in different fields. For example, in mine detection, different sensing techniques have been advantageously combined to give greater detection sensitivity and certainty than seen with single sensing capabilities.

What is needed is to apply a sensor fusion technique to the art of detection of nuclear threats hidden inside shipping containers.

SUMMARY OF THE INVENTION

To address the shortcomings of the available art, the present invention provides methods and means for detection and identification of threats hidden inside cargo shipments while in transit by using a sensor fusion technique. Each such nuclear threat is assumed to be either hidden inside at least one cargo container before transit, or to be placed inside at least one cargo container while in transit. Each such nuclear threat while interacting with its surroundings generates a unique nuclear threat signature.

One aspect of the present invention is directed to a method for identifying at least one nuclear threat to homeland security by continuously processing the array of selected statistically significant detected nuclear threat signatures.

In one embodiment, the method of the present invention comprises: (A) detecting at least one nuclear threat signature; (B) measuring a background nuclear threat signature distribution in a nuclear threat-free environment; (C) comparing each detected nuclear threat signature with the background nuclear threat signature distribution; (D) if deviation of the detected nuclear threat signature from the background nuclear threat signature distribution is statistically significant, selecting the detected nuclear threat signature to be a part of an array of statistically significant detected nuclear threat signatures; and (E) substantially continuously processing the array of selected statistically significant detected nuclear threat signatures in order to determine a likelihood of each nuclear threat.

The step (A) of detecting at least one nuclear threat signature can be preferably performed by using: a γ-ray detector, an x-ray detector, a muon detector, and/or an acoustic detector.

In one embodiment of the present invention, the step (A) of detecting at least one nuclear threat signature by using an acoustic detector comprises: transmitting an acoustic impulse by using an acoustic transmitter and detecting a transmitted acoustic impulse by using an acoustic receiver to determine sound transit time through an interior of the cargo container.

In another embodiment of the present invention, the step (A) of detecting at least one nuclear threat signature by using an acoustic detector comprises: transmitting an acoustic impulse by using an acoustic transmitter and detecting an acoustic impulse reflected from a material inside the cargo container by using an acoustic receiver to determine acoustic reflection coefficient from the interior of the cargo container and to calculate acoustic impedance of the material inside the cargo container.

Another aspect of the present invention is directed to a method for identifying at least one nuclear threat to homeland security by selecting each statistically significant nuclear threat signature into an N-array of nuclear threat signatures, N being an integer.

In one embodiment, the method of the present invention comprises: (A) detecting at least one nuclear threat signature; (B) selecting an array of statistically significant detected nuclear threat signatures; (C) generating a statistically significant nuclear threat signature signal corresponding to each detected nuclear threat signature having a statistically significant deviation from a background nuclear threat signature distribution; (D) consulting a database of predetermined thresholds associated with a plurality of known nuclear threat signatures; (E) comparing each statistically significant nuclear threat signature signal with at least one predetermined threshold associated with the plurality of known nuclear threat signatures; (F) selecting each statistically significant nuclear threat signature that exceeds at least one predetermined threshold associated with the plurality of known nuclear threat signatures into an N-array of nuclear threat signatures, N being an integer; (G) if the integer number N of statistically significant nuclear threat signatures signals exceeds a predetermined number $N_{array_threshold}$, determining a likelihood of each nuclear threat that generates at least one statistically significant nuclear threat signature signal that exceeds at least one predetermined threshold; and (H) if the likelihood of at least one of the nuclear threats determined in the step (G) exceeds a predetermined likelihood threshold, identifying each such nuclear threat as a nuclear threat to homeland security.

One more aspect of the present invention is directed to an apparatus for identifying at least one nuclear threat to homeland security.

In one embodiment of the present invention, the apparatus comprises: (A) a means for detecting at least one nuclear threat signature; (B) a means for measuring a background nuclear threat signature distribution in a nuclear threat-free environment; (C) a means for comparing each detected nuclear threat signature with the background nuclear threat signature distribution; and (D) a means for selecting the detected nuclear threat signature to be a part of an array of statistically significant detected nuclear threat signatures and for substantially continuously processing the array of selected statistically significant detected nuclear threat signatures in order to determine a likelihood of each such nuclear threat.

BRIEF DESCRIPTION OF DRAWINGS

The aforementioned advantages of the present invention as well as additional advantages thereof will be more clearly understood hereinafter as a result of a detailed description of a preferred embodiment of the invention when taken in conjunction with the following drawings.

DETAILED DESCRIPTION OF THE PREFERRED AND ALTERNATIVE EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
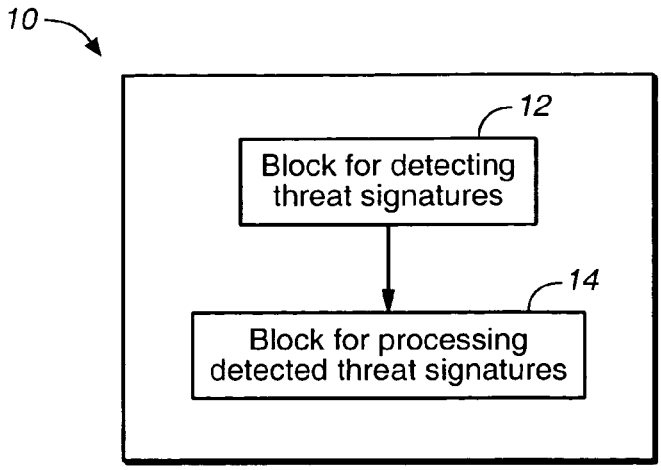
FIG. 1 illustrates the apparatus of the present invention comprising: (A) a block for detecting at least one nuclear threat signature, and (B) a block for processing each detected nuclear threat signature to determine a likelihood of at least one nuclear threat to become a threat to the homeland security.

In one embodiment, FIG. 1 depicts the apparatus of the present invention 10 comprising: (A) a block 12 for detecting at least one nuclear threat signature; and (B) a block 14 for processing each detected nuclear threat signature to determine a likelihood of at least one nuclear threat to become a threat to the homeland security.

As defined herein, threats are items that are not included on the manifest, because the security system was compromised at some point prior to sealing the container. While this is a necessary condition, it is not a sufficient one for illicit contents to be classified as a threat. To be a threat, undeclared cargo should also represent a significant hazard to the homeland. A package of cocaine would constitute illegal cargo but not a security threat.

It is assumed that each threat is either hidden inside at least one cargo container before transit, or is placed inside at least one cargo container while in transit. It is also assumed that each threat while interacting with its surrounding generates a unique threat signature. In the present patent application we focus on nuclear threat detection.

Referring still to FIG. 1, in one embodiment of the present invention, the block 12 for detecting at least one nuclear threat signature further comprises (A1) a block for detecting each nuclear threat signature by detecting exchange of energy and/or matter of the nuclear threat with its surroundings.

Figure 2:
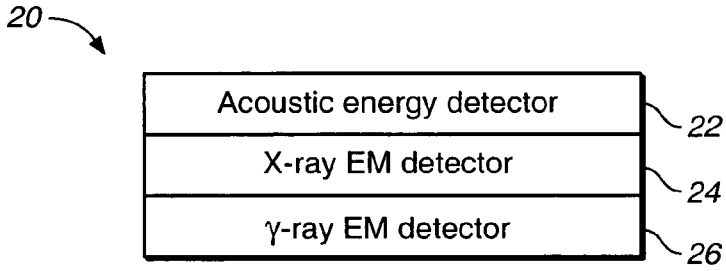
FIG. 2 depicts the block for detecting a form of exchanged energy of the nuclear threat with its surroundings for the purposes of the present invention.
Figure 3:
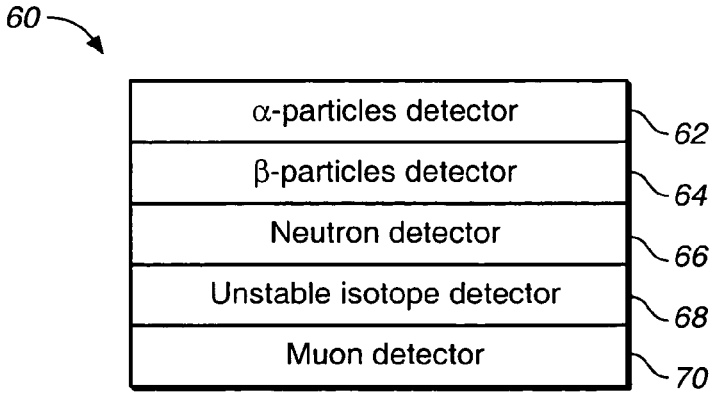
FIG. 3 illustrates the block for detecting an exchange of matter of the nuclear threat with its surroundings by detecting particles for the purposes of the present invention.

In one embodiment of the present invention, as shown in diagram 20 of FIG. 2, the block (A1) for detecting at least one nuclear threat signature by detecting an exchange of energy and/or matter of at least one nuclear threat with its surroundings further comprises an acoustic energy detector 22, an X-ray detector 24, a γ-ray electromagnetic energy (EM) detector 26, and/or muon energy detector 70 (of FIG. 3).

In the present application we will focus on the sensor fusion technique that allows one to combine acoustic energy detectors configured to detect a nuclear object inside cargo container with several nuclear energy detectors per se including an X-ray detector 24, a γ-ray electromagnetic energy (EM) detector 26, and a muon detector 70.

Acoustic emission (AE) is a nondestructive testing (NDT) technique that can be used for the purposes of the present invention to detect nuclear threat signatures associated with nuclear threats hidden inside a cargo container while in transit.

An Acoustic Sensor (AS) can be mounted on the exterior surface of a cargo container to detect acoustic signals propagating inside the cargo container. The acoustic energy propagating inside the container decreases in amplitude as a function of distance from the source. This is known as signal attenuation. The acoustic energy propagating inside the container can be also reflected from a sufficiently heavy object inside the container. This is known as signal reflection. Obtaining attenuation and reflection characteristics of acoustic signals propagating inside a cargo container can be useful for the purposes of detection of a nuclear threat hidden inside a cargo container while in transit. Please, see discussion below.

Physical Acoustics Corp. (PAC) located at 195 Clarksville Road, Princeton Jct, N.J. 08550, USA, designs and manufactures acoustic emission sensors and acoustic emission measurement instruments under a quality program which is certified to ISO-9001 standards.

The latest digital electronics enhances the performance of AS. Data storage locks in the visual and audio indicators of changing conditions and indications of leaks. This allows one to maximize the inspection capability while eliminating any errors in logging test results. Computer interface downloads stores readings for permanent record, archiving or further analysis. High sensitivity over a broadband of frequencies is ideal for diverse applications of leaks in a variety of container structures.

General Purpose sensors are designed to be low cost, high sensitivity, resonant type sensors, medium size, medium temperature range, and are used in most AE applications. Due to the difference in cost between general purpose sensors and all other sensor families, one would move away from general purpose sensors only if there is a need for a different size or shape sensor due to space limitations, need for a different frequency range (e.g. wideband), different temperature (e.g. high or low temperature) or environmental (e.g. waterproof) requirement. As a rule, one should always look towards selection of a general purpose AE sensor first, since it has the best price and performance of all the rest of the sensor families.

In one embodiment of the present invention, a nuclear material hidden inside cargo container that transmits the X-ray energy can be detected by using an X-ray detection device.

Electron Tubes Ltd, located at Bury Street, Ruislip, HA4 7TA, Middlesex, UK, specializes in designing X-ray detection systems to meet customer requirements. These make use of scintillation and light detection techniques, both areas in which ETL has a very long experience. In addition ETL has the capability to design complete detector sub-systems including read-out electronics, data communications and signal processing.

The sensor element consists of a linear array of silicon photodiodes with a scintillation material mounted on the photodiodes. The X-rays are stopped by the scintillation, causing light to be emitted. The light produces charge in the photodiode which is processed by the electronic read-out system, generating an output which is proportional to the intensity of the incident radiation.

The choice of scintillation type and thickness depends on the X-ray energies and the speed of response of the system. The main options are cadmium tungstate and cesium iodide, used as single crystals, or gadox in the form of a phosphor deposited on a screen. The detection elements may be cooled by Peltier devices to achieve low noise and stabilize light output from the scintillation. The overall length and resolution of the detector can be chosen to meet customer requirements. Detectors are built up in the form of modules, normally with either 32 or 128 elements, depending on the pitch required. Modules can be butted end-to-end to provide a longer array, with a constant pitch being maintained along the whole length. The electronics is highly integrated and makes use of one of a range of multi-channel, monolithic charge integrating amplifiers developed specifically for X-ray detector read-out by the Rutherford Appleton Laboratory in the UK. These are very low noise devices with fast read-out, in serial form using an on-chip shift register. Sensitivity can be varied by means of integration time control.

In most applications signal-to-noise is limited by X-ray quantization noise, which is the theoretical ideal. ETL designs customized systems, which may also include other features such as on-board generation of clock and control signals, analogue to digital conversion, and a communications interface to transmit the data to a remote central processor. Particular attention is paid to protection of the electronics from radiation damage and lead screening is used to protect the most radiation sensitive elements.

In one embodiment of the present invention, the nuclear material hidden inside a shipping container can be detected by using a γ-ray detection device.

Gamma-Scout® is the latest development in handheld general purpose Geiger counters. Designed around an accurate and reliable Geiger-Müller detector, the Gamma-Scout® Geiger counter is light, compact, with a unique ergonomic design that fits comfortably in hand or pocket. The data from Geiger counter can be transferred to PC or Notebook for evaluation. Gamma-Scout® was developed by Eurami Group based in Baltimore, Md.

The Savannah River Technology Center developed a Real Time Sodium Iodide Gamma Detector (RADMAPS) that can be used for detecting, locating and characterizing nuclear material. The portable field unit records gamma or neutron radiation spectra and its location, along with the date and time, using an imbedded Global Positioning System. RADMAPS is advancement in data fusion, integrating several off-the-shelf technologies with new computer software in a product that is simple to use and requires very little training. The existing technologies employed in this system include: Global Positioning System satellite data, radiation detection (scintillation detector), pulse height analysis, Flash Memory Cards, Geographic Information System software and laptop or personal computers with CD-ROM supporting digital base maps. The software developed at the Savannah River Technology Center eliminates costly, error prone, manual data entry. An initial screening survey is performed to establish the level of naturally occurring (background) radiation. This screening survey becomes the point of reference as the detailed survey continues, looking for radiation 'spectra' (fingerprints). All pertinent data, including the time each spectrum is accumulated, is stored.

In one embodiment of the present invention, as shown in FIG. 3, the block 60 for detecting an exchange of matter of the threat with its surroundings by detecting particles selected from the group consisting of: {subatomic particles; elements; and molecules}.

In one embodiment of the present invention, referring to FIG. 3, the nuclear material hidden inside a shipping container can be detected by using an alpha particle detector 62. It is well known, that heavy radioactive elements emit alpha particles at discrete energy values.

The alpha particle detector is essentially a silicon diode with a large area face. Because alpha particles, which are high-speed helium nuclei, are electrically charged, they interact strongly with matter and lose their energy quickly upon entering a solid. When an alpha particle decelerates within the depletion region of the diode, it creates electron-hole pairs. The carriers are collected by the diode's electrodes and create a measurable current pulse.

Canberra Industries, located at 800 Research Parkway, Meriden, Conn. 06450, manufactures a modern version of the charged particle detector called PIPS, an acronym for Passivated Implanted Planar Silicon. The PIPS detector employs implanted rather than surface barrier contacts and is therefore more rugged and reliable than the Silicon Surface Barrier (SSB) detector it replaces.

At the junction there is a repulsion of majority carriers (electrons in the n-type and holes in p-type) so that a depleted region exists. An applied reverse bias widens this depleted region which is the sensitive detector volume, and can be extended to the limit of breakdown voltage. PIPS detectors are generally available with depletion depths of 100 to 700 m. Detectors are specified in terms of surface area and alpha or beta particle resolution as well as depletion depth. The resolution depends largely upon detector size, being best for small area detectors. Alpha resolution of 12 to 35 keV and beta resolutions of 6 to 30 keV are typical. Areas of 25 to 5000 $m^2$ are available as standard, with larger detectors available in various geometries for custom applications.

The A series of PIPS detectors manufactured by Canberra Industries are optimized for high resolution, high sensitivity, and low background alpha spectroscopy. The thin window of the PIPS detector provides enhanced resolution with the close detector-source spacing needed for high efficiency. The low leakage current helps minimize peak shift with temperature variation. Detectors in the A-PIPS series are fabricated with specially designed and selected packaging materials which reduce alpha background and are processed and tested in low background conditions to avoid contamination from alpha-emitting radio nuclides. Because of these measures, the background count rate for A-series PIPS detectors is typically less than 0.05 counts/hr/cm$^2$ in the energy range of 3 to 8 MeV. Alpha PIPS detectors have a minimum active thickness of greater than 140 μm which is sufficient for full absorption of alpha particles of up to 15 MeV.

In one embodiment of the present invention, referring still to FIG. 3, the nuclear material hidden inside a shipping container can be detected by using a beta particle detector 64.

Beta particles are subatomic particles ejected from the nucleus of some radioactive atoms. They are equivalent to electrons. The difference is that beta particles originate in the nucleus and electrons originate outside the nucleus. While beta particles are emitted by atoms that are radioactive, beta particles themselves are not radioactive. It is their energy, in the form of speed that causes harm to living cells. When transferred, this energy can break chemical bonds and form ions.

Canberra Industries manufactures the B series of PIPS detectors optimized for beta counting and electron spectroscopy. The naturally-thin entrance window of the PIPS detector provides little attenuation for even weak betas but the B-PIPS is especially good in this application because of the extra thickness and low noise of this series. The minimum thickness of B-PIPS detectors is 475 μm. The B-series PIPS detectors are selected for low noise in order to: maximize the realizable efficiency for low energy betas, and to provide good resolution for conversion electrons. Since the minimum discriminator level (below which noise counts are excessive) is about 2.5-3 times the noise measured in (keV) FWHM, the low noise of the B-PIPS is extremely important in helping resolve true beta counts from system noise counts.

In one embodiment of the present invention, referring still to FIG. 3, the nuclear material hidden inside a shipping container can be detected by using a neutron detector 66.

Neutron is an electrically neutral elementary particle that is part of the nucleus of the atom. Elementary particles are the smallest parts of matter that scientists can isolate. The neutron is slightly heavier than a proton and 1,838 times as heavy as the electron. It is affected by all the four fundamental forces of nature. Because it has mass, it is affected by gravitation, the force of attraction between all objects in the universe. Although the neutron has no electrical charge, it is slightly magnetic, so it is affected by the electromagnetic force, the force of attraction or repulsion between electrically charged or magnetic objects. The neutron is affected by the strong nuclear force, an attraction that binds the neutron to protons and other neutrons in the nucleus. The neutron is also affected by the weak nuclear force, an interaction among the building blocks of the neutron that causes the neutron to decay, or break apart. Isolated from nuclear matter, a free neutron decays into a positively charged proton and a negatively charged electron, releasing energy in the process. The average lifetime of a free neutron is just under 15 minutes.

The most commonly deployed neutron detector is a proportional counter. It costs at least $30,000 for a model with a detection area of 1 square meter. Indeed, a proportional counter with a detection area of 1 square meter requires about twenty 1-meter-long gas-filled tubes, each costing about $1,200. Because a proportional counter uses gas multiplication, its detection signal is highly sensitive to gas impurities. Thus, the gas in a proportional-counter tube should be at least 99.999 percent pure. In fact, about half the cost of a helium-3 proportional-counter tube is in its high-purity gas.

Los Alamos Lab scientists have developed a rugged, inexpensive neutron detector—made largely of plastic—that could be mass-produced. Los Alamos scientist Kiril Ianakiev has developed an attractive alternative: a new breed of neutron detector. The detector's major parts include spark plugs, welding gas, and a briefcase-sized block of plastic that forms its body. The detector is rugged and inexpensive enough to be widely deployed. Ianakiev's detector which does not use gas multiplication works even with inexpensive welding-grade argon, which has a purity of 99.5 percent. Furthermore, the small amounts of oxygen, water vapor, and carbon dioxide slowly emitted from the detector's interior surfaces will be absorbed by the lithium coating, so that outgassing will not affect detector performance for twenty years or more.

Ianakiev's detector is also a good neutron detector: it detects 10 percent of the neutrons emitted by plutonium-240 that strike it. Weapons-grade plutonium typically contains about 5 percent plutonium-240. By comparison, a proportional counter detects 15 percent of the neutrons. But a proportional counter is also nearly ten times more expensive. One of Ianakiev's detectors with a 1-square-meter detection area will cost about $4,000. To further reduce the cost of deployment of Ianakiev's detectors, the mass-production techniques and inexpensive materials are being considered.

In one embodiment of the present invention, referring still to FIG. 3, the nuclear material hidden inside a shipping container can be detected by using an unstable isotopes detector 68.

Radioactivity is a property of unstable isotopes which undergo spontaneous atomic readjustment with the liberation of particles and/or energy (e.g., alpha or beta particles, neutrons, and gamma rays). Alpha and beta emission change the chemical nature of the element involved. The loss of energy will result in the decay or transformation of the unstable isotope into a stable isotope; or transmutation into an isotope of another element, sometimes giving rise to emission of neutrons.

Most unstable isotopes decay by releasing energy in the form of alpha or beta particles or gamma rays. However, there is a rare form of radioactive decay called proton radioactivity, produced when an unstable isotope releases a proton.

The process of radioactive decay is one of conversion of mass to energy in accordance with Einstein's relationship, $E=mc^2$. Nearly all of the energy of emitted particles and photons is converted to heat in the near vicinity of the radioactive parent. This is one means by which the temperature of the earth is maintained.

Nuclear Radiation Detector RS-500 detects: Alpha, Beta and Gamma particles and X-Rays. It has an operational range: 0-999 mR/hr and can detect the radioactive decay energy in the range: 40 KeV to 1.2 MeV or better. The six digit LCD screen displays either the instant radioactivity or the cumulative radiation exposure. The sensitivity is 3 to 5% of all gamma entering the tube. The RS-500 detector is widely available through the on-line shopping.

Thus, in one embodiment of the present invention, the RS-500 detector can be used to detect the presence of nuclear material inside the container which would constitute a clear and present danger to the national security.

In one embodiment of the present invention, referring still to FIG. 3, the nuclear material hidden inside a shipping container can be detected by using a muon detector 70.

Muons, elementary particles that shower down on Earth, hold promise as a sensitive means of detecting nuclear materials being smuggled into the country. Each minute, about 10,000 muons rain down on every square meter of Earth. These charged subatomic particles are produced when cosmic rays strike air molecules in the upper atmosphere. The cosmic rays themselves are mostly energetic protons produced by the sun, our galaxy, and probably supernova explosions throughout the universe. Thousands of muons pass through us every minute, but they deposit little energy in our bodies and thus make up only a few percent of our natural radiation exposure. A team of Los Alamos scientists has found a promising way to use this natural source of radiation to detect terrorist attempts to smuggle uranium or plutonium into the country. Either nuclear material could be used to make an atomic bomb. The technique also detects lead and tungsten, which could be used to shield the gamma rays emitted by nuclear materials—or other radioactive materials—in order to elude detection. The new technique uses the fact that muons are more strongly deflected, or scattered, by nuclear or gamma-ray-shielding materials than they are by materials such as plastic, glass, and aluminum. This enhanced deflection occurs mainly because the atomic nuclei of nuclear and gamma-ray-shielding materials contain large numbers of protons, which exert large electrostatic forces on muons passing nearby. Since the number of protons is given by the atomic number Z, such materials are called "high-Z" materials. The deflection is also determined by how many nuclei a muon encounters while passing through the material, which is proportional to the number of nuclei per unit volume—the number density. The number density equals the material's density divided by the mass of its nuclei. The materials that most strongly deflect muons have high atomic numbers and high number densities.

In muon detection, particle detectors above and below a vehicle or container record each muon's path before and after the muon passes through the cargo. A change in a muon's trajectory means the muon has been scattered by the cargo. Using the path information and muon scattering theory, a computer program then constructs a three-dimensional image of the cargo's dense, high-Z objects.

Figure 3A:
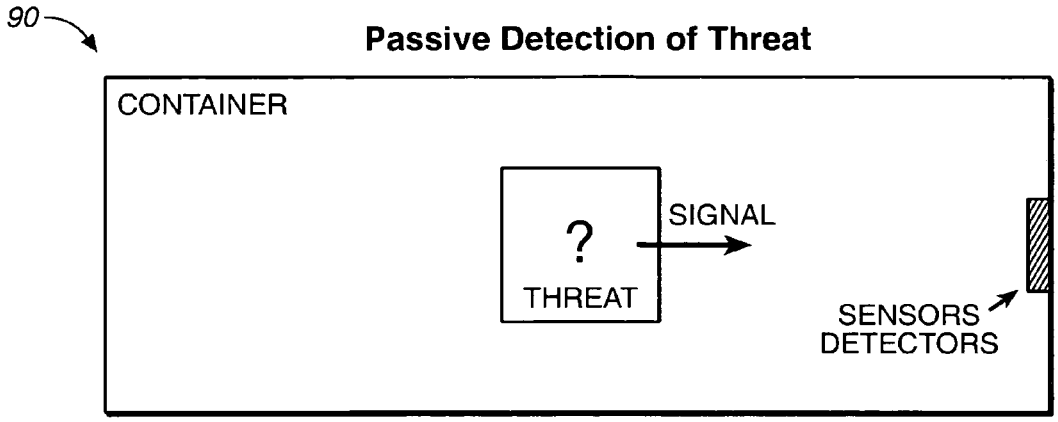
FIG. 3A illustrates a passive detection of nuclear threat for the purposes of the present invention.
Figure 3B:
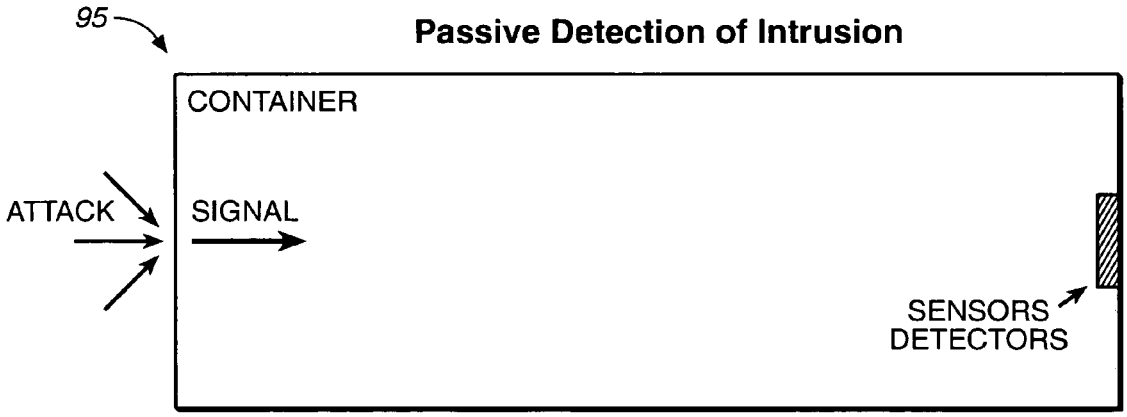
FIG. 3B is an illustration of a passive detection of intrusion for the purposes of the present invention.
Figure 4A:
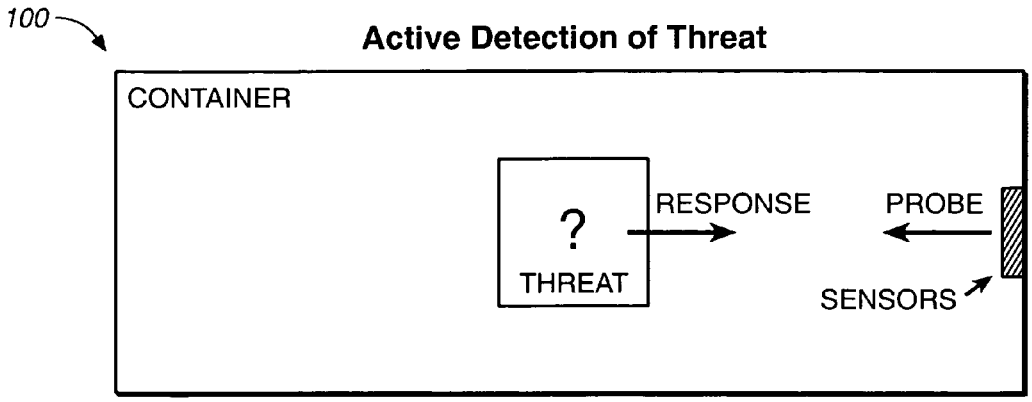
FIG. 4A illustrates an active detection of nuclear threat for the purposes of the present invention.
Figure 4B:
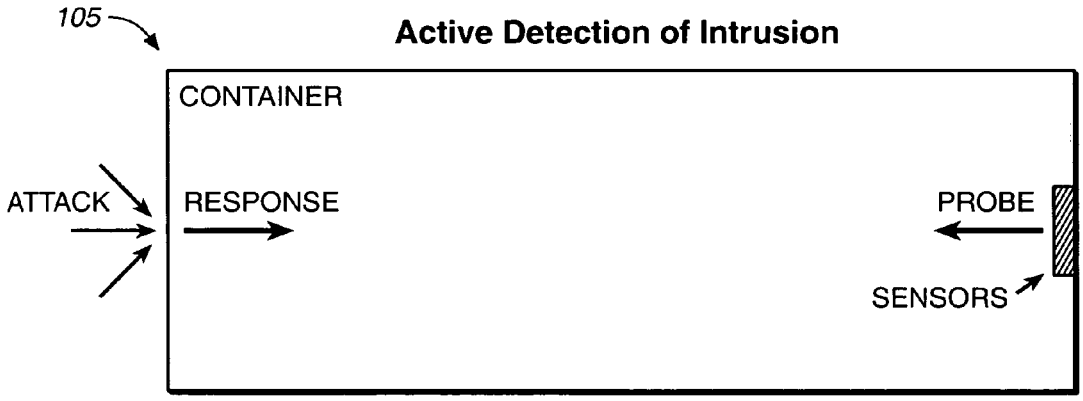
FIG. 4B is an illustration of an active detection of intrusion for the purposes of the present invention.

All detectors disclosed above are considered to be passive detectors, as illustrated in FIGS. 3A-3B, or active detectors, as illustrated in FIGS. 4A-4B.

Referring to FIG. 1, in one embodiment of the present invention, some functions of the block 12 for detecting at least one threat signature by detecting an exchange of energy and/or matter of at least one threat with its surroundings can be implemented by using an electrical sensor configured to produce an output electrical signal based on the detected exchange of energy and/or matter of at least one threat with its surroundings for further sensor fusion processing by a standard computer.

If a signal produced by a detected threat signature is measured many times, the individual measurements will cluster about some average value. The average value of the detected threat signature may or may not be well known. In fact, it may only be approximately known, or it may even change with time. In one embodiment of the present invention, however, it is only necessary that the average value of the detected threat signature varies slowly with respect to the interval between measurements. The time scale will depend on the particular source of the threat signature being measured.

Typically, any given measurement differs from the average value associated with the signal being measured. This deviation from the average may be due to systematic error or random statistical fluctuation. Systematic errors bias all measurements, including the average. This bias affects the accuracy of the measurements but is not particularly troublesome because it is possible to compensate for systematic bias.

Statistical fluctuations are more basic. They can be minimized but not eliminated. The inherent uncertainty associated with the measurement of any variable exists even at the quantum level. Thus, an ensemble of measurements is needed to produce a spread of values. If the number of occurrences of each measured value is plotted against the value, the result is a histogram. The histogram is generally peaked around the average value and tails off on either side thus representing a real distribution of the values of a variable being measured.

A distribution, standard or otherwise, can be characterized in terms of its moments. The first moment is called the mean. This is just the average value of the distribution. The second moment is called the variance. This is a figure of merit that characterizes the spread of the distribution. The larger the variance, the broader the distribution. Higher-order moments characterize other properties of the histogram.

When no threat is present, a series of measurements made on the ambient environment will produce some distribution of values. The mean and standard deviation of this baseline distribution can be thought of as the background against which a threat should be detected. In the absence of statistical fluctuations, any threat, no matter however weak, can be differentiated from the background.

However, statistical fluctuations cannot be eliminated from the measurement process. Therefore, threat signals should be identified by detecting statistically significant deviations from the average.

Figure 4C:
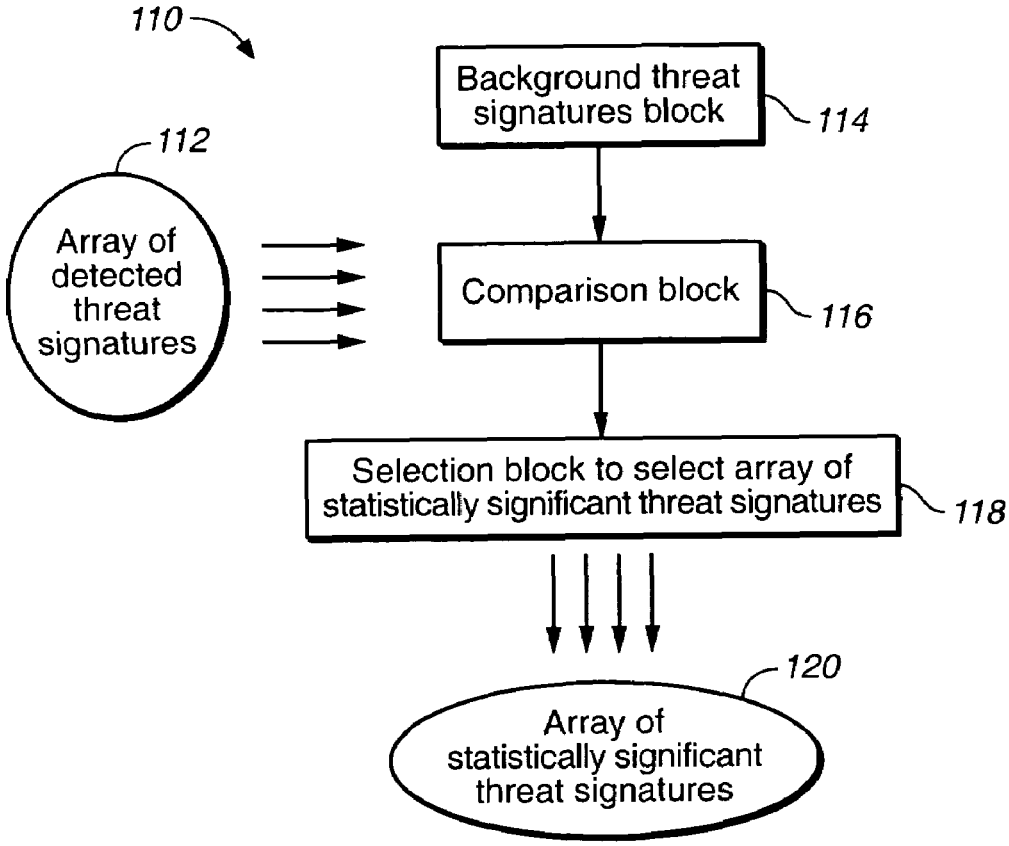
FIG. 4C depicts the block for selecting an array of statistically significant nuclear threat signatures for the purposes of the present invention.

In one embodiment of the present invention, FIG. 4C depicts the block 110 for selecting an array of statistically significant threat signatures further comprising a block 114 configured to for measure a background threat signature distribution in a threat-free environment, a block 116 configured to compare each detected threat signature signal 112 with the background threat signature distribution; and a block 118 configured to select the detected threat signature to be a part of the array 120 of the statistically significant detected threat signatures for further processing, if deviation of the detected threat signature signal from the background threat signature distribution is statistically significant.

At the simplest level, the detection task is a two-step process: (1) some value between the known distribution of background measurements and the distribution of chosen threat signals is picked as the critical value; and (2) if a given measurement falls to a predetermined side of this critical value, it is classified as a threat; if it falls to the opposite side, it is classified as background.

If the threat signal is assumed to be strong, its average will lie from the average of the background. Even in the presence of statistical fluctuations, threat signals will typically fall far from any background signals. In this case, the critical value can be chosen almost somewhere between the two distributions, and the chance of misidentifying one or the other will be small.

On the other hand, if the threat signal is assumed to be weak, its average will lie close to the average of the background. In the presence of statistical fluctuations, threat signals will overlap background signals. In this case, no matter what critical value is chosen, some threat signals will be classified as background (referred to as false negatives) and some background signals will be classified as threats (referred to as false positives). Depending on the choice of critical value, the relative numbers of false negative and false positives can vary substantially.

Thus, referring still to FIG. 4C, the selection for further processing in block 118 of statistically significant threat signatures that statistically significantly deviate from the background threat signature distribution ensures the minimization of both false negative threat signatures and false positives threat signatures.

However, with a single sensor modality operating close to the threshold of detection, a low false negative rate necessarily entails a high false positive rate; and vice versa. A high rate of false negatives can have serious security consequences; a high rate of false positives can have serious economic consequences. Ideally, both rates should be low. One way around this dilemma is to use multiple sensor modalities to search for threats.

Figure 5:
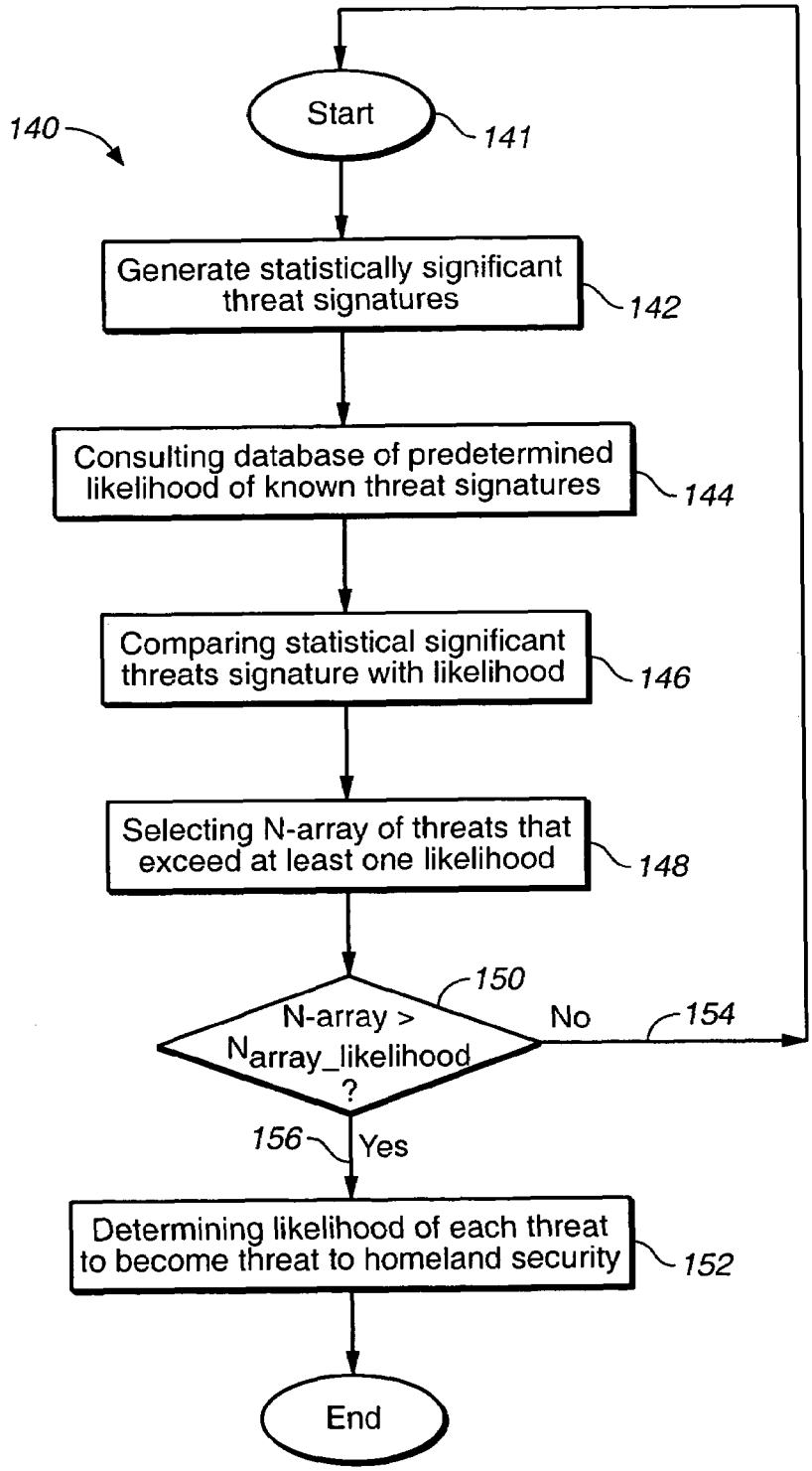
FIG. 5 illustrates the block for substantially continuously processing the array of the selected statistically significant nuclear threat signatures for the purposes of the present invention.

Thus, in one embodiment of the present invention, FIG. 5 illustrates the block 140 for substantially continuously processing the array of the selected statistically significant threat signatures (120 of FIG. 4C) further comprising: a block 142 for generating a statistically significant threat signal corresponding to each detected threat signature having the statistically significant deviation from the background threat signature distribution; a block 144 for consulting a database of predetermined thresholds associated with a plurality of known threat signatures; a block 146 for comparing each statistically significant threat signature signal with at least one predetermined threshold associated with the plurality of known threat signatures; a block 148 for selecting each statistically significant threat signature signal that exceeds at least one predetermined threshold associated with the plurality of known threat signatures into an N-array of threat signatures; a test block 150 to determine if the number of threat signatures selected into an N-array is greater than $N_{array_thershold}$; and a block 152 for determining the likelihood of each threat generating at least one statistically significant threat signature signal exceeding at least one predetermined threshold to become a threat to the homeland security.

Referring still to FIG. 5, to decrease the low false negative rate and to decrease the high false positive rate, we use the idea of sensor fusion—we need a certain number N of statistically significant threat signature signals to exceed at least one predetermined threshold associated with the plurality of known threat signatures to be greater than $N_{array_thershold}$, before one should start the threat identification process in block 152 of FIG. 5.

The U.S. Pat. No. 5,051,723, issued to Long et al. and incorporated by reference herein in its entirety, discloses a self-contained theft and vandalism deterrent system for equipment security that includes a number of sensors for detecting conditions to which an alarm is responsive. The analog signals from the sensors are serially delivered by a multiplexer circuit when they are then directed to a network for conversion to digital signals. The digital signals are delivered to a microprocessor where the signals are evaluated to determine if an alarm condition exists. The sending means include sound and vibration detectors for monitoring the ambient envelope. The microprocessor includes built in reprogramming and comparator circuits for varying the levels at which a given condition will trigger an alarm response.

In one embodiment of the present invention, the block for processing the detected threat signals 14 of FIG. 1 can be implemented by using sensor ambient envelope processor developed in '723 patent.

More specifically, in one embodiment of the present invention, the block 140 comprises an Ambient Envelope Sensor-fusion (AES) platform of '723 patent that has a transparent open bus structure and accepts multiple sensor data stream inputs, interprets and interpolates the sensor data and outputs alarms, warnings and authorized requested data. In this embodiment, the AES platform provides for data fusion which uses multiple sets of data streams to significantly improve performance as compared with the situation when the same sensors are used separately. The AES platform can include a history record to develop an ambient envelop within each container.

In the present patent application we focus on detection of very dense nuclear materials. Indeed, at least in theory, as little as 9 pounds of plutonium would be needed to make a fissile bomb.

The nuclear materials such as plutonium or enriched uranium have very high mass numbers and densities. Shields intended to hide the presence of such materials, such as a casing of lead, also have high mass numbers. Such materials can be in principle detected by using γ-ray, x-ray, or muon detectors, as was discussed above. However, these systems are well known to be unreliable, wherein false alarms are generated by quarry tile, cat litter, fertilizer, and even by bananas.

In one embodiment of the present invention, the described-above sensor fusion techniques is used to combine a plurality of nuclear detectors with acoustic detectors to increase the likelihood of positive identification of very dense nuclear materials and to decrease the probability of false positive alarms.

Plutonium and uranium, and other materials consisting of elements with high atomic numbers, absorb energy at distinctively high energies associated with the energies needed to dislodge electrons from their outer electron shells. This physical behavior causes very high acoustic impedance $Z_2$. For example, a discontinuity from low or normal acoustic impedance $Z_1$ in surrounding materials or air causes an untypical high amount of backscatter from the surface of the high density material. This backscatter or reflection is well-known to be described by the reflection coefficient:

$$R = \left(\frac{Z_1 - Z_2}{Z_1 + Z_2}\right). \quad \text{(Eq.1)}$$

Estimates of this reflection coefficient and acoustic material of the surrounding benign material can then provide an estimate of the acoustic impedance of the suspect material:

$$Z_2 = Z_1\left(\frac{1 + R}{1 - R}\right), \quad \text{(Eq.2)}$$

where $Z_1$, the acoustic impedance of the benign material, is not precisely known. Yet it can be presumed to be much lower in magnitude than that of the dangerous material, $|Z_2|$. Thus, the magnitude and phase shift seen in the reflection coefficient R can be significantly affected by the sharp boundary between normally lower density benign materials (including air) and higher density materials such as uranium, plutonium, or lead.

In addition, since the benign material would necessarily occupy most of the volume of something as large as a shipping container, overall acoustic transit times can, for example, be used to estimate the impedance of the benign materials $Z_1$.

Figure 6:
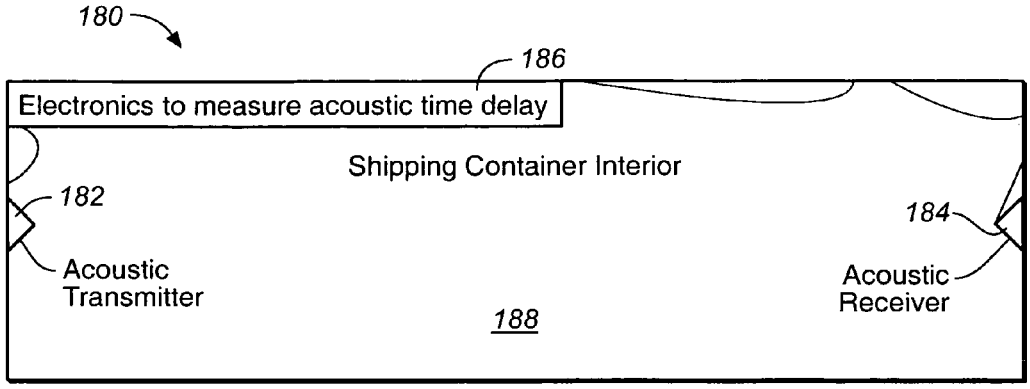
FIG. 6 is an example of the configuration for acoustic transit time measurement for the purposes of the present invention.

In one embodiment of the present invention, the acoustic component of the sensor fusion technique utilized to increase the likelihood of positive identification of very dense nuclear materials (and to decrease the probability of false positive alarms) can be estimated by performing the following steps:

Step 1: Transmit an acoustic impulse (or chirp) (by using an acoustic transmitter 182) and detect the transmitted acoustic impulse (or chirp) (by using an acoustic receiver 184) to determine the sound transit time through the interior of the container 188, as shown in FIG. 6. The electronics 186 combines this measurement with temperature to determine, from the estimate of sound speed, average impedance $Z_1$ of the (dominating) benign materials (or air) in the container.

Figure 7:
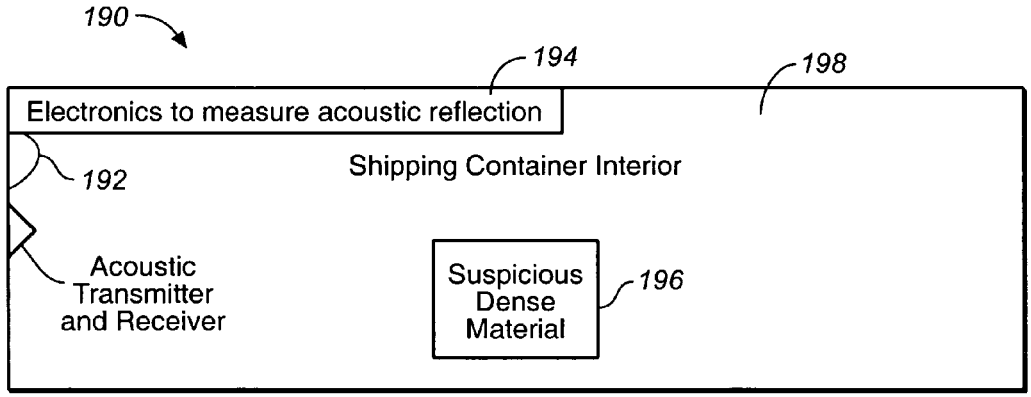
FIG. 7 illustrates an example of the configuration for acoustic reflection measurement for the purposes of the present invention.

Step 2: Transmit an acoustic impulse (or chirp) (by using an acoustic transmitter 192) and detect the acoustic impulse (or chirp) reflected from the suspicious dense material 196 (by using an acoustic receiver 192) to determine the acoustic reflection coefficient R from the interior of the container, as shown in FIG. 7. The function of the electronics 194 is also to calculate the suspect acoustic impedance $Z_2$. High magnitudes of this $Z_2$ could indicate the presence of suspect materials.

Performing a temporal averaging of the two above-given measurements, both of acoustic transit time and of acoustic reflection, could be used to increase accuracy.

The foregoing description of specific embodiments of the present invention has been presented for purposes of illustration and description. These specific embodiments are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. Therefore, it is intended that the scope of the invention be defined by the claims appended hereto and their equivalents, rather than by the foregoing description. All changes which come within the meaning and range of equivalency of the claims are to be embraced within their scope.

What is claimed is:

1. A method for identifying at least one nuclear threat to homeland security; each said nuclear threat either being hidden inside at least one cargo container before transit, or being placed inside at least one cargo container while in transit; each said nuclear threat while interacting with its surroundings generates a unique nuclear threat signature; said method comprising:

(A) detecting at least one nuclear threat signature;

(B) measuring a background nuclear threat signature distribution in a nuclear threat-free environment;

(C) comparing each said detected nuclear threat signature with said background nuclear threat signature distribution;

(D) if deviation of one or more of said detected nuclear threat signatures from said background nuclear threat signature distribution is statistically significant, selecting said one or more detected nuclear threat signatures to be a part of an array of statistically significant detected nuclear threat signatures;

and (E) substantially continuously processing said array of selected statistically significant detected nuclear threat signatures in order to determine a likelihood of each said nuclear threat.

2. The method of claim 1, wherein said step (A) further comprises:

(A1) using a γ-ray detector to detect at least one nuclear threat signature.

3. The method of claim 1, wherein said step (A) further comprises:

(A2) using an x-ray detector to detect at least one nuclear threat signature.

4. The method of claim 1, wherein said step (A) further comprises:

(A3) using a muon detector to detect at least one nuclear threat signature.

5. The method of claim 1, wherein said step (A) further comprises:

(A4) using an acoustic detector to detect at least one nuclear threat signature.

6. The method of claim 5, wherein said step (A4) further comprises:

(A4, 1) transmitting an acoustic impulse by using an acoustic transmitter and detecting a transmitted acoustic impulse by using an acoustic receiver to determine a sound transit time through an interior of said cargo container.

7. The method of claim 5, wherein said step (A4) further comprises:

(A4, 2) transmitting an acoustic impulse by using an acoustic transmitter and detecting an acoustic impulse reflected from a material inside said cargo container by using an acoustic receiver to determine an acoustic reflection coefficient from said interior of said cargo container and to calculate an acoustic impedance of said material inside said cargo container.

8. A method for identifying at least one nuclear threat to homeland security; each said nuclear threat either being hidden inside at least one cargo container before transit, or being placed inside at least one cargo container while in transit; each said nuclear threat while interacting with its surroundings generates a unique nuclear threat signature; said method comprising:

(A) detecting at least one nuclear threat signature;

(B) selecting an array of statistically significant detected nuclear threat signatures;

(C) generating a statistically significant nuclear threat signature signal corresponding to each said detected nuclear threat signature having a statistically significant deviation from a background nuclear threat signature distribution;

(D) consulting a database of predetermined thresholds associated with a plurality of known nuclear threat signatures;

(E) comparing each said statistically significant nuclear threat signature signal with at least one said predetermined threshold associated with said plurality of known nuclear threat signatures;

(F) selecting each said statistically significant nuclear threat signature signal exceeding at least one said predetermined threshold associated with said plurality of known nuclear threat signatures into an N-array of nuclear threat signatures, N being an integer;

(G) if said integer number N of statistically significant nuclear threat signatures signals exceeds a predetermined number $N_{array_threshold}$, determining a likelihood of each said nuclear threat generating at least one said statistically significant nuclear threat signature signal exceeding at least one said predetermined threshold;

and (H) if said likelihood of at least one of said nuclear threats determined in said step (G) exceeds a predetermined likelihood threshold, identifying each said nuclear threat as a nuclear threat to homeland security.

9. The method of claim 8, wherein said step (A) further comprises:

(A1) using a γ-ray detector to detect at least one nuclear threat signature.

10. The method of claim 8, wherein said step (A) further comprises:

(A2) using an x-ray detector to detect at least one nuclear threat signature.

11. The method of claim 8, wherein said step (A) further comprises:

(A3) using a muon detector to detect at least one nuclear threat signature.

12. The method of claim 8, wherein said step (A) further comprises:

(A4) using an acoustic detector to detect at least one nuclear threat signature.

13. The method of claim 12, wherein said step (A4) further comprises:

(A4, 1) transmitting an acoustic impulse by using an acoustic transmitter and detecting a transmitted acoustic impulse by using an acoustic receiver to determine a sound transit time through an interior of said cargo container.

14. The method of claim 12, wherein said step (A4) further comprises:

(A4, 2) transmitting an acoustic impulse by using an acoustic transmitter and detecting an acoustic impulse reflected from a material inside said cargo container by using an acoustic receiver to determine an acoustic reflection coefficient from said interior of said cargo container and to calculate an acoustic impedance of said material inside said cargo container.

15. An apparatus for identifying at least one nuclear threat to homeland security; each said nuclear threat either being hidden inside at least one cargo container before transit, or being placed inside at least one cargo container while in transit; each said nuclear threat while interacting with its surroundings generates a unique nuclear threat signature; said apparatus comprising:

(A) a means for detecting at least one nuclear threat signature;

(B) a means for measuring a background nuclear threat signature distribution in a nuclear threat-free environment;

(C) a means for comparing each said detected nuclear threat signature with said background nuclear threat signature distribution;

and (D) a means for selecting one or more of said at least one detected nuclear threat signatures to be a part of an array of statistically significant detected nuclear threat signatures and for substantially continuously processing said array of selected statistically significant detected nuclear threat signatures in order to determine a likelihood of each said nuclear threat.

16. The apparatus method of claim 15, wherein said means (A) further comprises:

(A1) a γ-ray detector configured to detect at least one nuclear threat signature.

17. The apparatus method of claim 15, wherein said means (A) further comprises:

(A2) an x-ray detector configured to detect at least one nuclear threat signature.

18. The apparatus method of claim 15, wherein said means (A) further comprises:

(A3) a muon detector configured to detect at least one nuclear threat signature.

19. The apparatus method of claim 15, wherein said means (A) further comprises:

(A4) an acoustic detector configured to detect at least one nuclear threat signature.

20. The apparatus method of claim 15, wherein said acoustic detector further comprises:

an acoustic transmitter configured to transmit at least one acoustic impulse inside said cargo container;

and an acoustic receiver configured to detect at least one acoustic impulse inside said cargo container;

wherein a sound transit time through an interior of said cargo container is determined; and wherein an acoustic reflection coefficient from said interior of said cargo container is determined; and wherein an acoustic impedance of a material inside said cargo container is determined.

* * * * *